US006837647B2

(12) United States Patent
Tagg

(10) Patent No.: US 6,837,647 B2
(45) Date of Patent: Jan. 4, 2005

(54) MODULAR BARRIER

(75) Inventor: Richard Leach Tagg, Sandhutton (GB)

(73) Assignee: RLT (Design) Limited, Sandhutton (GB)

( * ) Notice: Subject to any disclaimer, the term of this patent is extended or adjusted under 35 U.S.C. 154(b) by 0 days.

(21) Appl. No.: 10/433,384

(22) PCT Filed: Nov. 29, 2001

(86) PCT No.: PCT/GB01/05284

§ 371 (c)(1),
(2), (4) Date: May 29, 2003

(87) PCT Pub. No.: WO02/44476

PCT Pub. Date: Jun. 6, 2002

(65) Prior Publication Data

US 2004/0057790 A1 Mar. 25, 2004

(30) Foreign Application Priority Data

Nov. 29, 2000 (GB) ..... 0029027

(51) Int. Cl.[7] ..... E01F 13/00
(52) U.S. Cl. ..... 404/6; 256/13.1
(58) Field of Search ..... 404/6; 256/13.1

(56) References Cited

U.S. PATENT DOCUMENTS

| | | | | | |
|---|---|---|---|---|---|
| 5,104,255 | A | * | 4/1992 | Bodensohn | 404/7 |
| 5,123,773 | A | * | 6/1992 | Yodock | 404/6 |
| 5,387,049 | A | * | 2/1995 | Duckett | 404/6 |
| 5,498,101 | A | * | 3/1996 | Braverman | 404/6 |
| 5,531,540 | A | * | 7/1996 | Wasserstrom et al. | 404/6 |
| 5,836,714 | A | | 11/1998 | Christensen | |
| 5,988,934 | A | | 11/1999 | Wasserstrom | |
| 6,059,491 | A | * | 5/2000 | Striefel et al. | 405/111 |
| D441,409 | S | * | 5/2001 | Tagg | D21/483 |
| 6,413,009 | B1 | * | 7/2002 | Duckett | 404/6 |
| 6,439,801 | B1 | * | 8/2002 | Galiana et al. | 404/6 |
| 6,485,224 | B1 | * | 11/2002 | Dyke et al. | 404/6 |
| 6,669,402 | B1 | * | 12/2003 | Davis et al. | 404/6 |

FOREIGN PATENT DOCUMENTS

| | | |
|---|---|---|
| EP | 0957206 A1 | 11/1999 |
| FR | 1430536 A | 1/1966 |
| GB | 2292404 A | 2/1996 |
| GB | 2357107 A | 6/2001 |
| WO | WO 99/53145 A1 | 10/1999 |

* cited by examiner

*Primary Examiner*—Gary S. Hartmann
(74) *Attorney, Agent, or Firm*—Edwin D. Schindler

(57) ABSTRACT

A modular barrier includes a plurality of substantially identical barrier sections each section having a base portion surmounted by an upright portion. The upright portion has projections with substantially semi-cylindrical outer surfaces at its ends. Correspondingly shaped recesses are also provided. At a femal end, the base portion includes a nose. The surface of the nose is a surface of rotation of the profile of the base portion. At the male end, the base portion includes a correspondingly shaped cavity. The first and second projections and the nose are provided with bores. When the female end of the barrier section is brought up to a male end of a similar, adjacent barrier section, the projections mate with one another and the nose is received in the cavity of the adjacent barrier section. A hinge pin may then be passed through the bores for allowing one barrier section to be articulated to an adjacent barrier section with the joint between the two portions of adjacent barrier sections presenting an essentially smooth profile irrespective of the angle between the two adjacent barrier sections.

21 Claims, 14 Drawing Sheets

MODULAR BARRIER

BACKGROUND TO THE INVENTION

This invention relates to modular barriers of the type used in crowd and traffic control.

Conventional modular traffic control barriers consist of a number of barrier sections made from cast concrete. Each barrier section has a comparatively narrow upright portion surmounted by a comparatively wide base portion. Metallic ties are cast into the concrete and project from both ends of the upright portion of the barrier section. When two barrier sections are placed side-by-side, the metallic ties line up and can be bolted through, thus attaching the barrier sections to one another and at the same time forming a makeshift hinge. By means of the hinge, the two barrier sections can be articulated relative to one another, allowing the completed barrier to follow a serpentine path if desired.

Similar designs are in use for crowd control barriers. An example is described in U.S. Pat. No. 5,836,714. The barrier in question is particularly well illustrated in FIG. 9 of that document. The barrier is modular, being constructed of a series of substantially identical barrier sections. Each section is articulated to an adjacent section or two adjacent sections by means of a pin that passes through shaped projections in the sections. Upper and lower shaped projections are formed at one end of each section and a median shaped projection is formed at the other end. In this way, the pin passes through an upper projection of one section, a median projection of an adjacent section and then the lower projection of the first section. Each section is ramp-shaped and lies almost entirely to one side of the line drawn between the two articulating pins of the section in question. This arrangement allows the barrier to bend in one direction, opening up a gap between the adjacent ramp-shaped sections, but does not permit it to bend in the other direction.

A modular traffic control barrier in which adjacent sections are connected to one another by a pin is described in U.S. Pat. No. 4,681,302. However, this barrier is one in which no articulation of the sections relative to one another is possible. Instead, if a bend is required in the barrier, shaped inserts and additional connecting pins have to be introduced between sections. FIGS. 5–8 of the document illustrate a number of configurations that can be achieved with such inserts.

A more flexible modular traffic control barrier is described in international patent application no. WO99/53145. Here the barrier sections, viewed in plan, have a semicircular nose at one end and a corresponding semicircular recess at the other. However, because of its shape, the barrier is of uniform width rather than possessing a wide base and a narrow upright portion, which means that either it is very wide or it is likely to fall over. The noses and recesses mean that adjacent barrier sections may be placed at an angle to each other. UK patent application no. GB 2,292,404 A describes something similar.

Traffic control barriers tend to be made of heavy, impact-resistant materials such a concrete, because of the very high lateral impact forces that need to be withstood. Crowd control barriers on the other hand tend to be made of relatively light materials and are not required to be impact-resistant. These contradictory requirements have led to the development of different classes of barriers.

SUMMARY OF THE INVENTION

The present invention provides a modular barrier that can be used for both crowd and traffic control purposes. The modular crowd and traffic control barrier includes:

a plurality of barrier sections, each comprising an upright portion having one or more projections at each end and a base portion;

a plurality of reinforcing strips; and means for attaching each reinforcing strip to a respective barrier section;

in which for each such barrier section there exists another such barrier section such that when the female end of the barrier section is brought up to the male end of that other barrier section, the projections mate with one another, allowing a hinge pin to be passed through them to articulate the barrier sections together, for crowd control purposes; and in which attachment of the reinforcing strips to their respective barrier sections continues to permit them to be articulated together whilst increasing the resistance of a barrier constructed from the articulated barrier sections to lateral impact forces, for traffic control purposes.

For obvious reasons, it is preferred that the base portions of the barrier sections be comparatively wide as compared with the upright portions. Unless measures are taken to avoid it, as the adjacent barrier sections deviate more from being directly in line, a gap opens up between the edges of the base portion that lie towards the outside of the bend that the barrier is following. This opening can act as a wheel trap for unwary motorists. The same problem exists with barriers used for crowd control, except the gap is a tripping hazard. To address this problem, it is also preferred that the base portion includes, at a female end of the barrier section, a nose having a surface that is a surface of rotation and, at a male end, a cavity having a surface that is a surface of rotation. When the barrier sections are articulated to one another, the nose is accommodated in the cavity to prevent any gaps from opening up between the base portions of the two barrier sections as they are articulated relative to one another about the hinge pin.

Because the nose is a surface of rotation and the cavity is correspondingly shaped, the joint between the two base portions of adjacent barrier sections presents an essentially smooth profile irrespective of the angle between the two, which in preferred embodiments of the invention can vary between ±45 degrees. No gaps are opened up as the nose rotates within the cavity. Eventually, the base portion of the barrier section with a female end will impinge on the edge of the cavity in the base portion of the barrier section with a male end, thus preventing further movement, but on the other side, the exposed section of the nose presents an essentially smooth transition from the base portion of one barrier section to the base portion of the other. As a result, no openings are formed and the wheel trap or tripping hazard of conventional barriers is avoided.

There may be two reinforcing strips for each barrier section, one for each side of the respective barrier section. The means for attaching each reinforcing strip to a respective barrier section may comprise a tension member that passes through aligned apertures in the reinforcing strip and the barrier section, such as a bolt adapted to be tensioned by a cooperating nut.

Preferably, washers are used to spread the forces exerted at each end of the tension member, particularly when a motor vehicle impacts the barrier. It has been found especially effective to use washers that are dished and so shaped as to match the shape of a recess surrounding the aperture or apertures in the reinforcing strip and/or the barrier section through which the tension member passes.

Additional reinforcement can be provided by a reinforcing bracket that spans between two adjacent barrier sections and to be retained in place by at least one such tension member of each barrier section passing through an aperture in the reinforcing bracket. To continue to allow articulation of adjacent barrier sections, at least one aperture in the reinforcing bracket may be a substantially horizontal slot.

The reinforcing bracket may be located between the reinforcing strips and the barrier sections or with the reinforcing strips between it and the barrier sections. One such bracket on each side may be appropriate.

Returning to the case of traffic control, as described above, the need to hinge the barrier sections of the conventional sort away from the ends of the upright portions causes spaces between adjacent barrier sections. These can be a problem when the barriers are used for contra-flow systems at night: oncoming vehicles' lights can dazzle if they shine through these gaps. For this reason, it is preferred in the barrier section of the present invention that, for each projection, a corresponding recess is provided on the other end of the barrier section. As the projections of one barrier section will fit within the recesses in another, the gap between the two can be substantially closed. Taking this idea further, each projection may be given a surface that is a surface of rotation, for example substantially part-cylindrical. The respective corresponding recesses may then be correspondingly shaped. This arrangement ensures that no gaps open up between the upright portions as the barrier sections articulate relative to one another, just as the nose and cavity do for the base. The net result is of a tight-fitting hinge.

As with most hinges, each projection on a barrier section may be provided with a bore so that, when the female end of the section is brought up to a male end of another section so that the nose is accommodated in the cavity, the bores in the projections line up allowing a hinge pin to be passed through them to articulate the sections together. Further rigidity can be imparted to the hinge if the nose also includes a bore, allowing the hinge pin to pass through it.

When a plurality of barrier sections according to the invention and hinge pins are assembled into a modular barrier, the projections on a female end of a first barrier section mate with the projections on a male end of another barrier section and a hinge pin passes through them and through the nose of the first barrier section, to articulate the sections together. For traffic control purposes, the plurality of reinforcing strips are attached to their respective barrier sections, to continue to permit them to be articulated together whilst increasing the resistance of the barrier to lateral impact forces.

In a preferred implementation, the plurality of reinforcing strips are also able to be attached to their respective barrier sections and adjacent barrier sections, to prevent continued articulation of the barrier sections whilst increasing the resistance of the barrier to lateral impact forces.

To secure the hinge pin in place, it may have a male thread that engages with a female thread in a dome-shaped cap, the nose of the first barrier section having a dome-shaped recess to accommodate the cap. The dome-shaped cap can be bolted down to the ground before the barrier is erected. The cap and the recess are dome-shaped so that, although the spacing between adjacent caps is critical, their relative orientation is not, making their installation a much simpler proposition.

Further strength can be imparted to the assembled barrier if the barrier sections are also held together by tension straps that encircle adjacent barrier sections, crossing from one side of the barrier to the other between the barrier sections. These can spread impact forces across a number of adjacent barriers. For ease of installation of the straps, the upright portion of each barrier section may be provided with grooves to accommodate them.

Male and female end pieces can be used to complete the barrier. One or more openings in the side of the upright portions may be used to accommodate indicia such as reflective arrows or speed limit signs etc.

BRIEF DESCRIPTION OF THE DRAWINGS

The present invention will now be described by way of example with reference to the accompanying drawings in which.

DETAILED DESCRIPTION OF THE INVENTION

Figure 2:
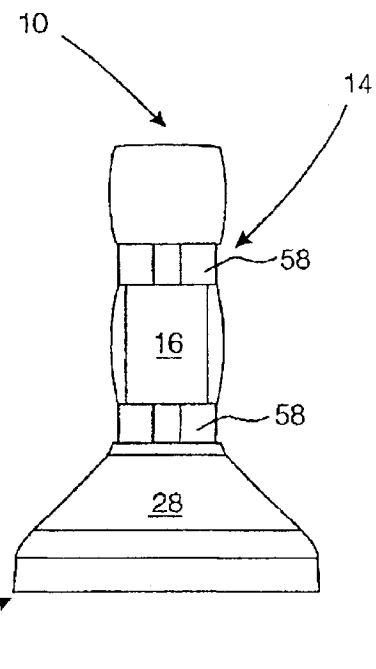
FIG. 2 is an end view of the female end.
Figure 1:
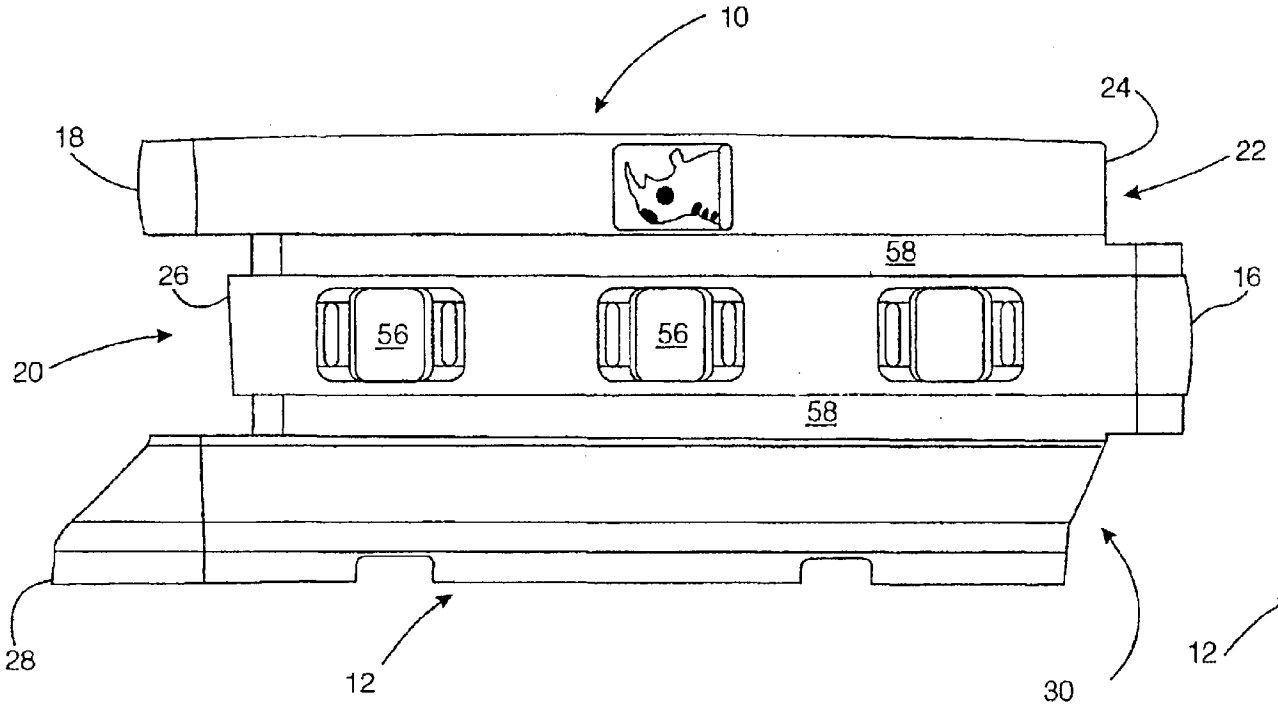
FIG. 1 is a side view of a barrier section, showing the female end on the left and the male end on the right.
Figure 3:
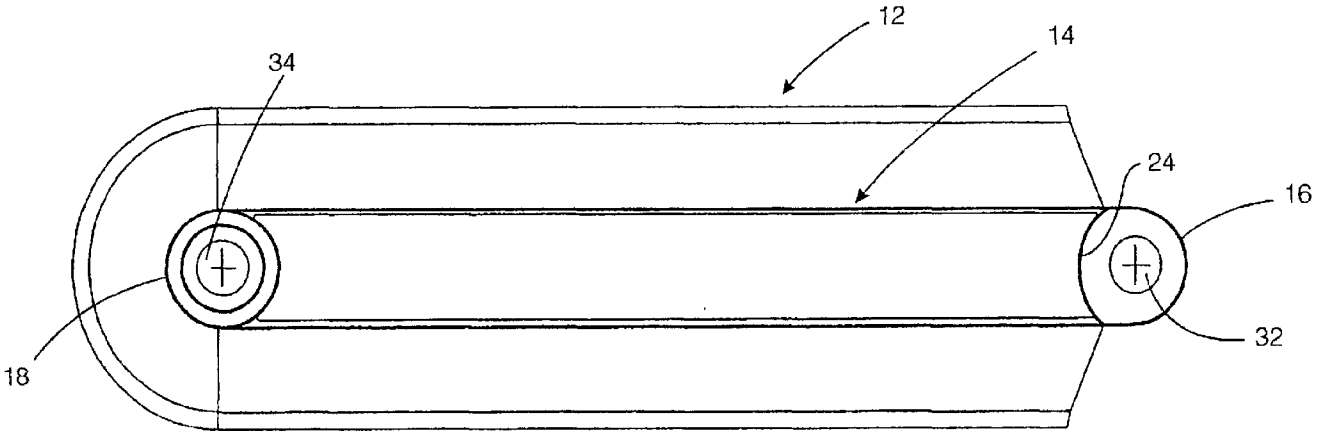
FIG. 3 is a plan view.

FIGS. 1 and 2 show a barrier section 10 that is formed by rotation moulding from high-density polyethylene. Because the barrier section is rotation moulded, it is hollow and can be filled with water when in use for traffic control. To that end it is provided with a filling port and a drain plug (not shown). The barrier section includes a comparatively wide base portion 12 surmounted by a comparatively narrow upright portion 14. The upright portion has a first projection 16 at a male end of the barrier section and a second projection 18 at the female end. As is more clearly shown in FIG. 3, when considered in conjunction with FIGS. 1 and 2, both projections have substantially semicylindrical outer surfaces. The first projection 16 is designed to fit into a correspondingly shaped first recess 20 that lies below the second projection 18 of a similar barrier section. The second projection 18 is designed to fit into a correspondingly shaped second recess 22 that lies above the first projection 16 of the similar barrier section. As can again be seen from FIG. 3, when considered in conjunction with FIGS. 1 and 2, the second recess 22 includes a part-cylindrical surface 24. The same is true of the first recess 20 and surface 26.

At the female end, the base portion 12 includes a nose 28. The surface of the nose is a surface of rotation of the profile of the base portion 12. At the male end, the base portion 12 includes a correspondingly shaped cavity 30, better illustrated in FIG. 4. The first and second projections 16, 18 are provided with bores 32, 34 and the nose 28 is also provided with a bore 36. The nose also includes an inverted dome-shaped or part spherical recess 38 that will be described later.

When the female end of the barrier section 10 is brought up to a male end of a similar section, the projections mate with one another. The first projection 16 is received in the first recess 20 below the second projection 18 of the similar section. The second projection 18 of the similar section is received in the second recess 22 above the first projection 16. The corresponding substantially part-cylindrical surfaces of the projections 16, 18 and recesses 20, 22 are in close proximity to one another. The nose 28 is received in the cavity 30 of the similar section, again with their surfaces in close proximity. A hinge pin (not shown) may then be passed through the bores 32, 34, 36, in that order, and screwed down or otherwise fixed into a dome-shaped cap (not shown) that sits within the recess 38 in the nose 28. The pin may be made from plastics, e.g. nylon, or a metal such as steel. The pin head may have a socket to receive a warning lantern.

By means of this device, one barrier section 10 can be articulated to the next. As will be appreciated, because the nose 28 is a surface of rotation and the cavity 30 is correspondingly shaped, the joint between the two base portions 12 of adjacent barrier sections 10 presents an essentially smooth profile irrespective of the angle between the two. Movement is eventually restricted by the base portion 12 of one barrier section 10 impinging on the edge of the cavity 30 in the base portion of the other barrier section 10. However, on the other side, the exposed section of the nose 28 forms an essentially smooth arcuate transition from the base portion 12 of one barrier section 10 to the base portion 12 of the other. Similarly, as the projections 16, 18 of one barrier section 10 fit within the recesses 20, 22 in the other and vice versa, the gap between the two is substantially closed. Again, the semicylindrical surfaces of the projections 16, 18 and recesses 20, 22 ensure that no gaps open up between the upright portions 14 as the barrier sections 10 articulate relative to one another, just as the nose 28 and cavity 30 do for the base 12. The net result is of a tight-fitting hinge and this helps to prevent a driver being dazzled by oncoming vehicles' lights, especially where the barrier is used in a contra-flow system at night. It also avoids the wheel trap or tripping hazard of conventional barriers.

Figure 7A:
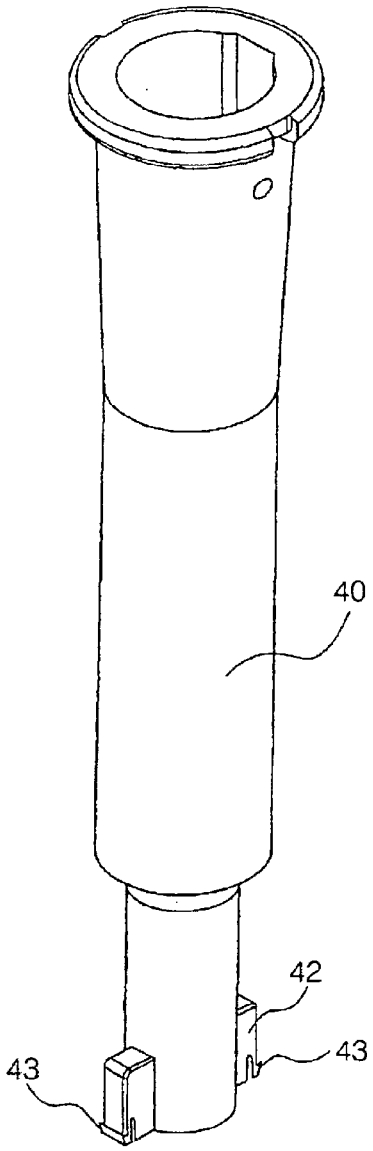
FIGS. 7*a* and 7*b* show an alternative form of hinge pin.
Figure 7B:
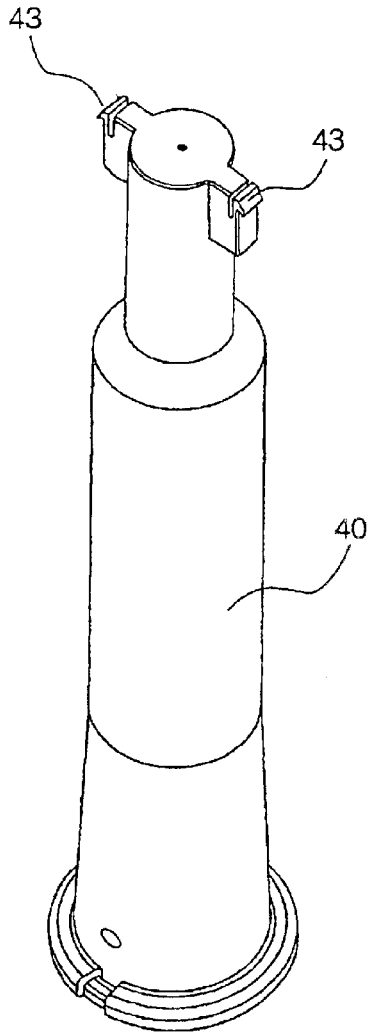
Figure 8A:
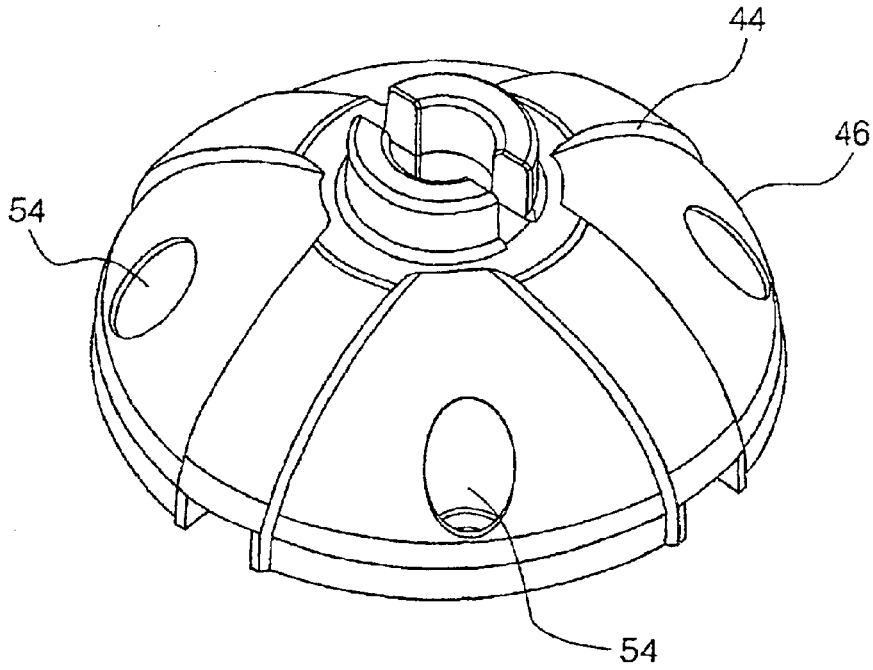
FIGS. 8*a* and 8*b* show a cap for use with the hinge pin of FIGS. 7*a* and 7*b;*
Figure 8B:
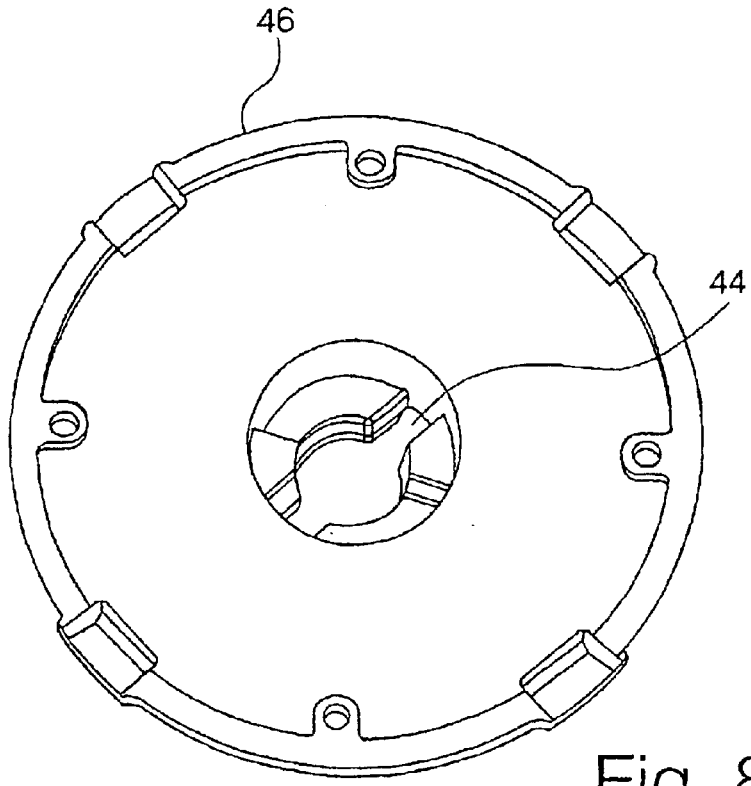
Figure 9:
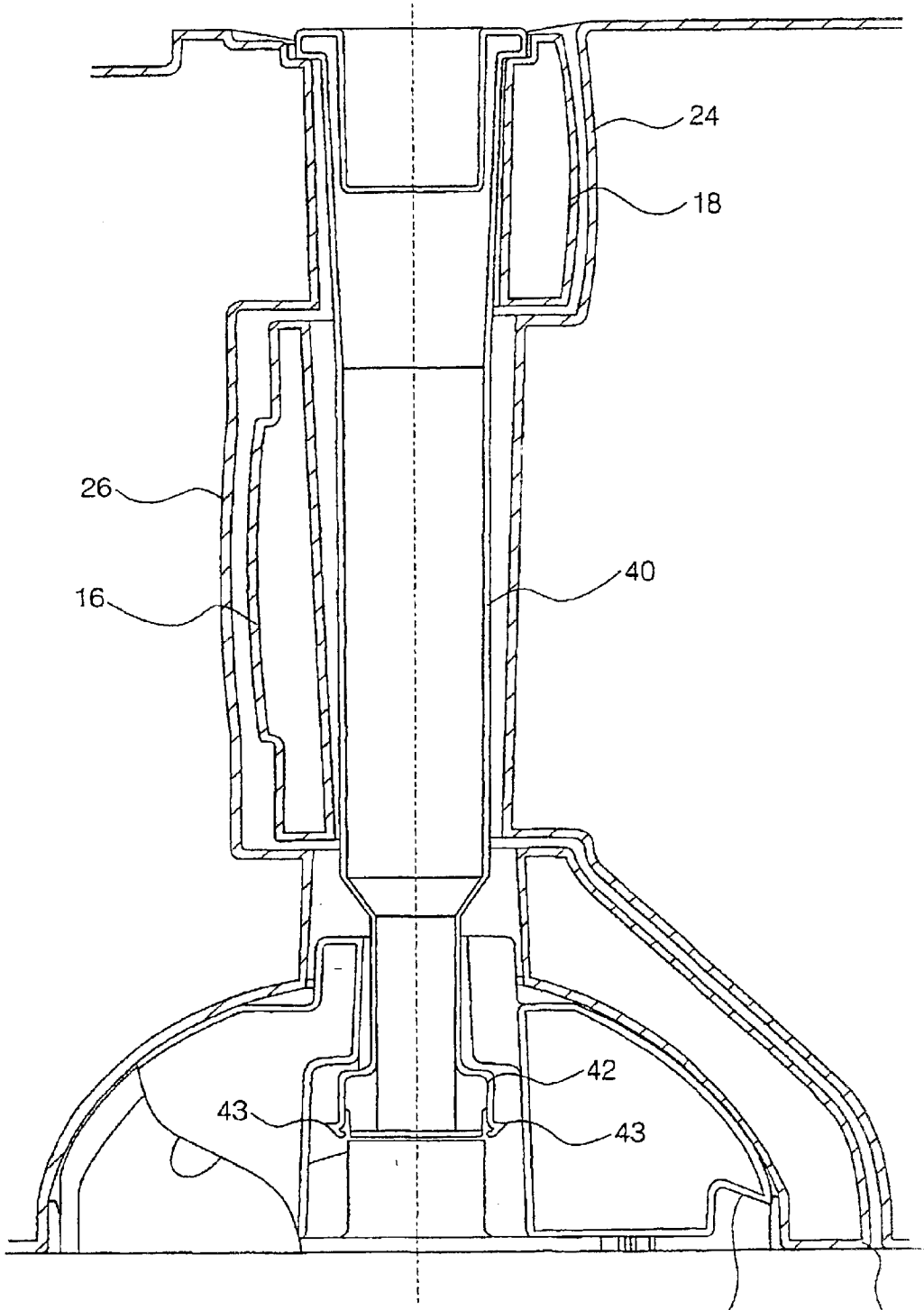
FIG. 9 is a section through a barrier using the hinge pin of FIGS. 7*a* and 7*b* and the cap of FIGS. 8*a* and 8*b;*

As stated above, the hinge pin may have a male thread that engages with a female thread in a dome-shaped cap, the nose of the first barrier section having a dome-shaped recess to accommodate the cap. Alternatively, as shown in FIGS. 7*a*–8*b*, the hinge pin 40 may have a bayonet fitting 42 that slots into appropriate bayonet grooves 44 in the cap 46. As shown in FIGS. 7*a* and 7*b*, the bayonet fitting 42 includes at its extremities a pair of resilient clips 43. The purpose of the clips 43 is to prevent the withdrawal of the hinge pin 40 from the barrier sections without compression of the clips 43. This is a useful safeguard if the bayonet fitting 42 becomes undone. The compression of the clips 43 can be achieved by a suitable tool. The cap 46 may be made of plastics, such as nylon, or metal, such as steel or cast iron. It may be fixed in place by a spike on its lower surface and/or bolted down to the ground with shock bolts through three or four deeply countersunk holes 54 before the barrier is erected. Alternatively, it may be left loose or otherwise secured. An appropriately shaped friction mat could be laid beneath it. The mat may be high-density rubber or polyurethane foam, preferably with a rough-sawn or other high friction surface. Because the caps 46 are dome-shaped, or at least circular when viewed from above, they need only be secured at predetermined centres; their relative orientation is not critical, making their installation a much simpler proposition FIG. 9 is a section through a barrier using a hinge pin 40 and cap 46 that have the bayonet fittings 42, 44 described above. As can be seen from FIG. 7*a*, a recess 47 is created at the top of the pin 40, which is formed by rotational moulding, to accept a standard highway light.

As can be seen from FIG. 1, each barrier section 10 includes one or more openings 56 in the side that may be used to accommodate indicia such as reflective arrows or speed limit signs, etc. Furthermore, a pair of grooves 58 run along each side and continue around the recesses 20, 22 to join identical grooves on the other side of the barrier section 10. Adjacent barrier sections can be held in place by tension straps (not shown) that encircle them, located within the grooves 58, crossing from one side of the barrier to the other between the barrier sections 10, somewhat in the form of a figure-of-eight, or a number of superposed figures-of-eight. A suitable material would be 75 mm by 6 mm polypropylene straps. The tension straps may be installed relatively loosely and, once in place, tightened by a ratchet mechanism. The tension straps spread impact forces across a number of adjacent barrier sections 10, better dissipating the impact.

Figure 13:
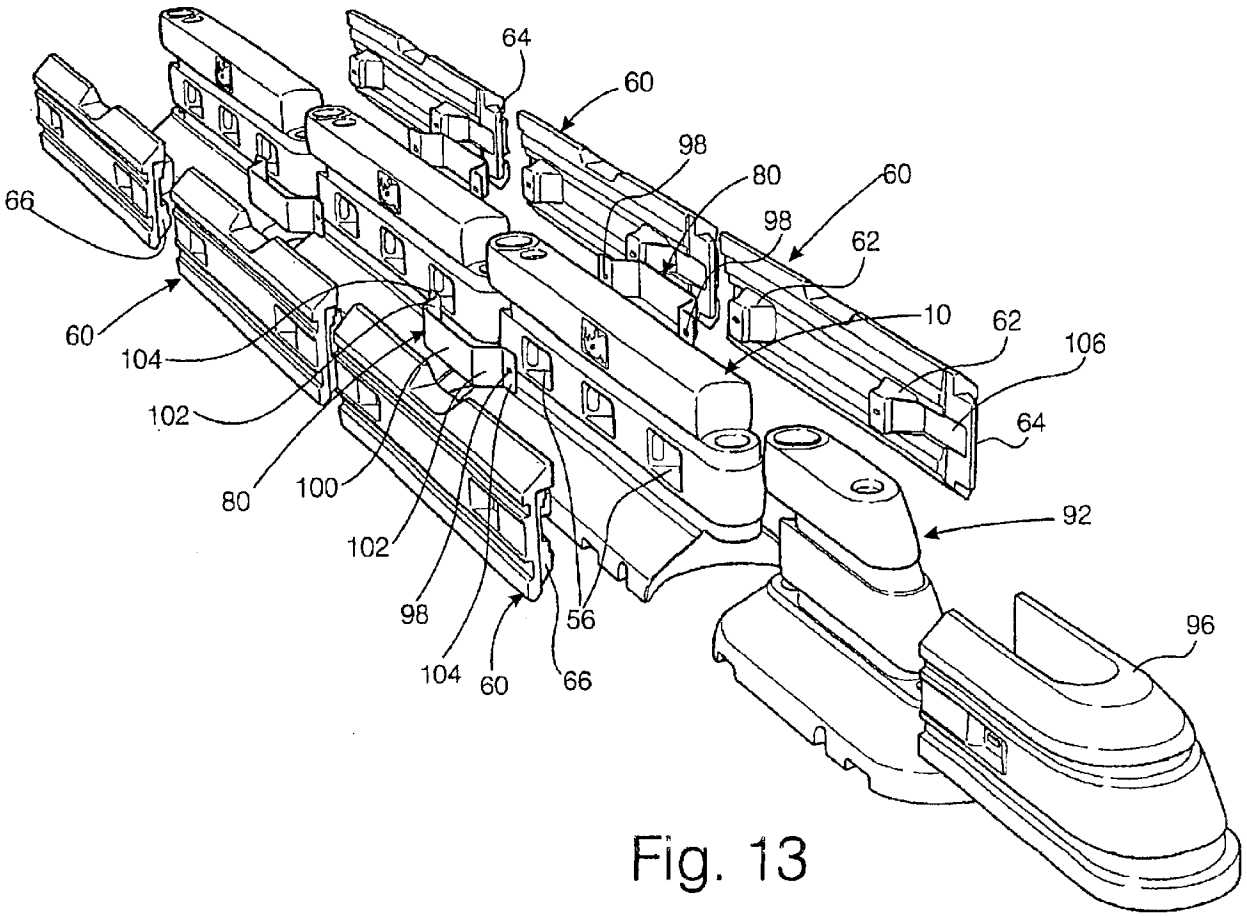
FIG. 13 is an exploded view of a barrier incorporating reinforcing strips and reinforcing brackets, for traffic control use.

FIG. 13 is an exploded view of a barrier incorporating reinforcing strips 60 and reinforcing brackets 80, for traffic control use. The strips 60 have a polyethylene skin filled with expanded polyurethane foam and are sacrificial in the sense that, if one suffers a very heavy impact from a moving vehicle, its polyethylene skin is designed to burst, assisting the polyurethane foam filling in absorbing the impact energy. This helps to protect, and maintain the integrity of, the barrier sections. Of course, the strips can be made from other materials, such as concrete, timber or metal, as can the barrier sections themselves. Each strip 60 is profiled to fit a barrier section. It includes bosses 62 that are designed to pass through the openings 56 of a barrier section and abut the bosses 62 of a corresponding strip 60 on the other side. In this way, two strips 60 are accommodated on each barrier section 10. The strips 60 are bolted to one another via the openings 56. As can be seen from FIG. 13, the strips 60 are designed to interlock with strips 60 on an adjacent barrier section, but in such a way as to continue to permit the articulation of the sections relative to one another. This is achieved with a boss 64 at one end of a strip 60 engaging a notch 66 in the other end of an adjacent strip. Preferably, the strips 60 are manufactured by rotation moulding to form the skin and foam injection to form the filling. The reinforcing strips increase the resistance of a barrier constructed from the articulated barrier sections 10 to lateral impact forces, making it suitable for traffic control purposes.

As can be seen from FIG. 13, each barrier section 10 includes three openings 56, the leftmost and rightmost of which are used for securing the reinforcing strips 60 as shown. The central opening 56 appears to be redundant, but is not. Its purpose will be described in due course.

Figures 14A, 14B, 14C:
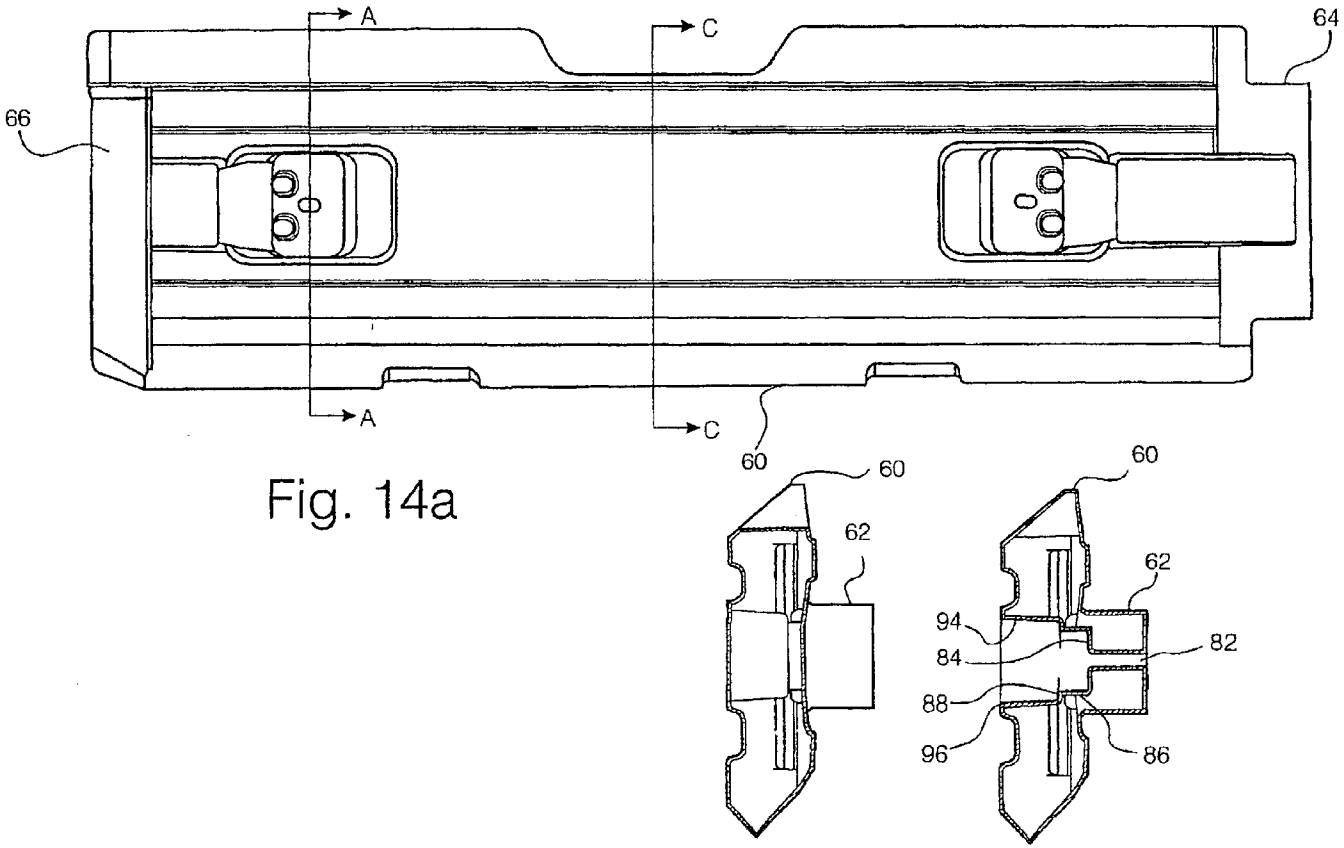
FIGS. 14*a*–14*e* show the reinforcing strip.
Figure 14D:
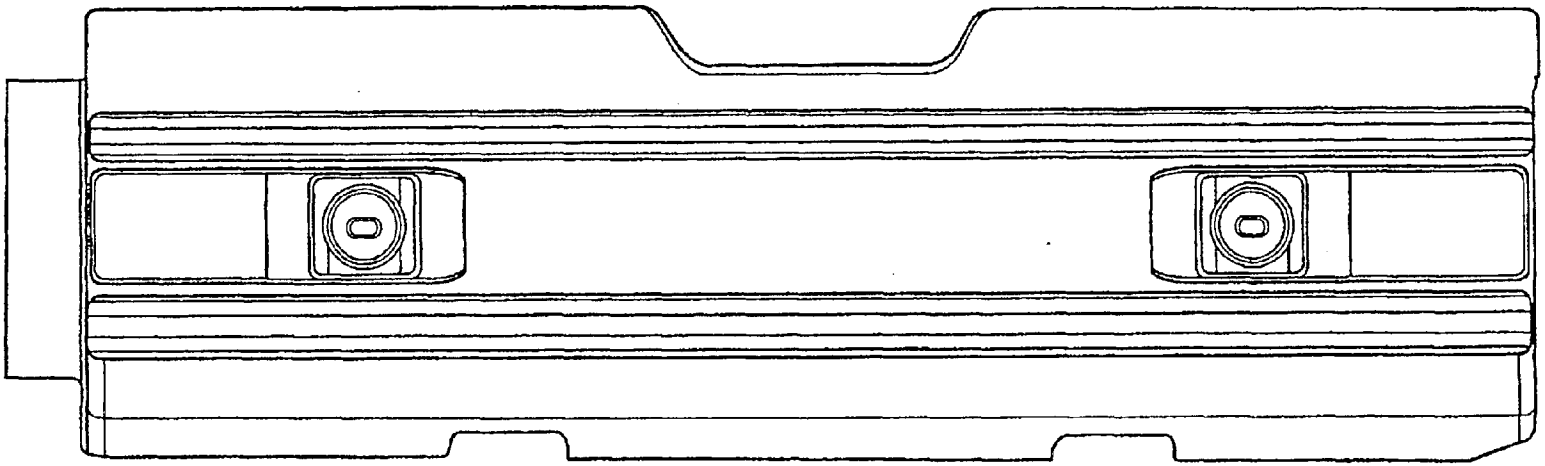
Figure 14E:
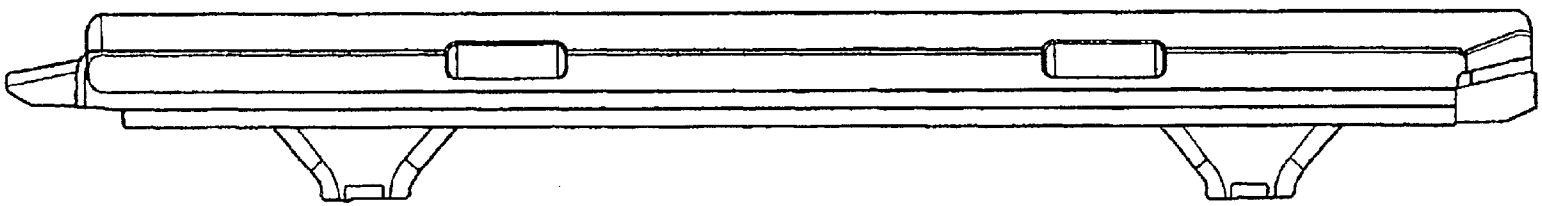

FIG. 14 shows a reinforcing strip in more detail. FIG. 14(*a*) shows the outer face of a reinforcing strip; FIGS. 14(*b*) and 14(*c*) are cross-sections through the strip of FIG. 14(*a*) along the lines C—C and A—A respectively. FIG. 14(*d*) shows the inner face and FIG. 14(*e*) is a plan view. As can be seen, each strip 60 includes bosses 62 that are designed to pass through the openings 56 of a barrier section and abut the bosses 62 of a corresponding strip 60 on the other side. The strips 60 are bolted to one another via the openings 56 by means of a bolt and nut combination provided with washers at each end (not shown). FIG. 14(*c*) illustrates the profiling of the reinforcing strip 60 around surrounding the aperture 82 via which it is bolted to the barrier section 10. The aperture includes a flat inner seat 84, surrounded by a substantially cylindrical inner wall 86. The transition from the inner seat 84 to the cylindrical inner wall 86 is rounded, as is the transition from the inner wall 86 to an annular lip 88. The annular lip 86 is surrounded by a substantially cylindrical outer wall 94. The transition from the inner lip 88 to the cylindrical outer wall 94 is rounded, as is the transition from the outer wall 94 to the outer surface 96 of the strip 60.

As mentioned above, the strips 60 are bolted to one another via the openings 56. In each case, the bolt (not shown) is first provided with a washer (not shown) and then passed through the aperture 82 in the boss 62 of a first reinforcing strip 60. The bolt passes through the opening 56 of the barrier section 10 and then the aperture 82 in the boss 62 of a second reinforcing strip 60. The end of the bolt is then provided with a second washer (not shown) before a nut (not shown) is tightened onto it to secure the various elements together. The washers may be flat, in which case they lie against the flat inner seat 84 of the recess surrounding the aperture 82 in the reinforcing strip 60. Preferably, however, the washer is dished and formed into substantially the same shape as the recess. The washer is preferably formed so as to lie flush with the flat inner seat 84 of the recess and to extend at least as far as the inner lip 88 in all directions. It may extend as far as the opening of the recess or even onto the flat outer surface 96 of the reinforcing strip 60 if desired. The washer helps to prevent the reinforcing strip 60 from being torn off its mountings in the event of a vehicle impact.

Figure 15:
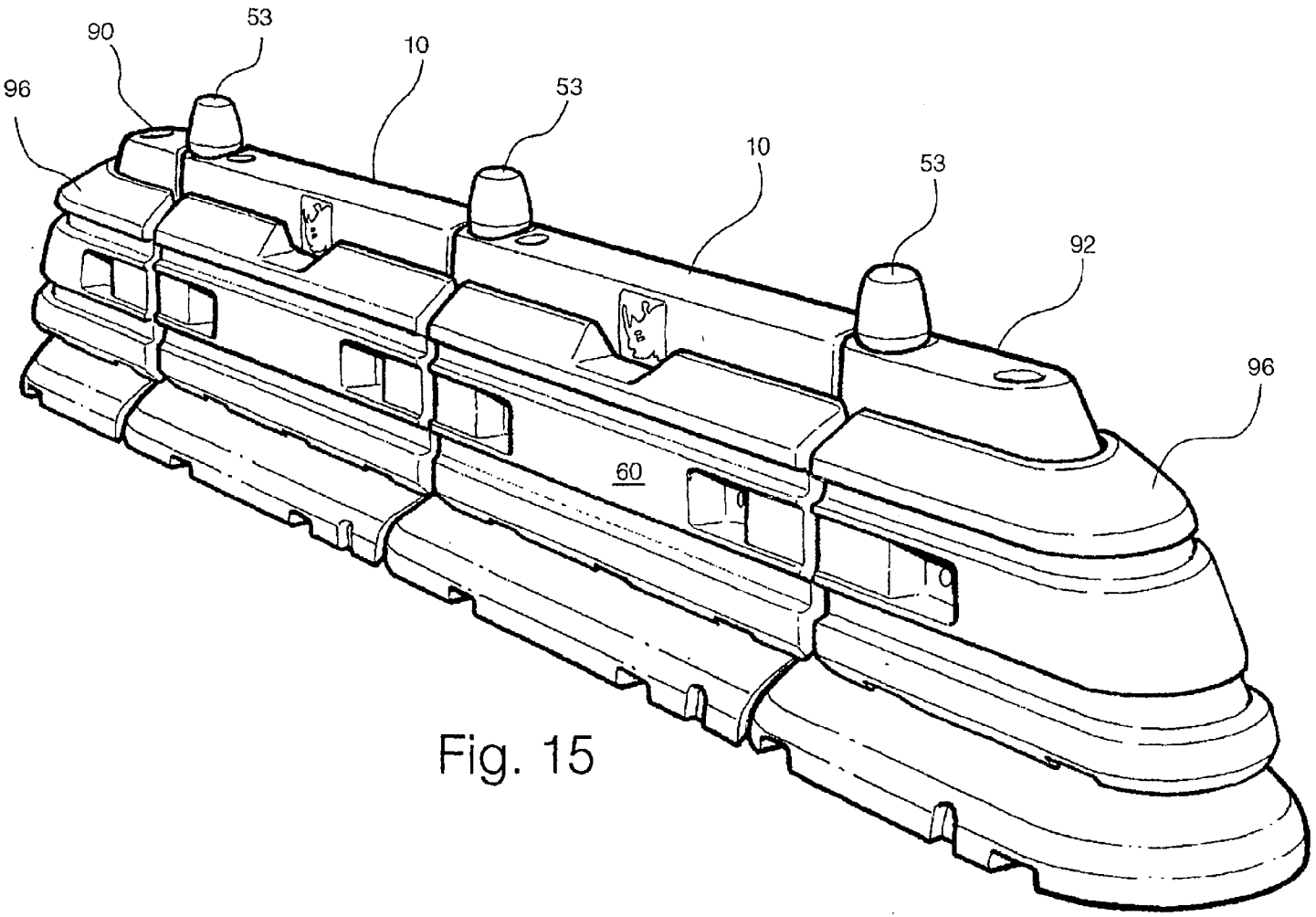
FIG. 15 shows the assembled barrier.
Figure 16:
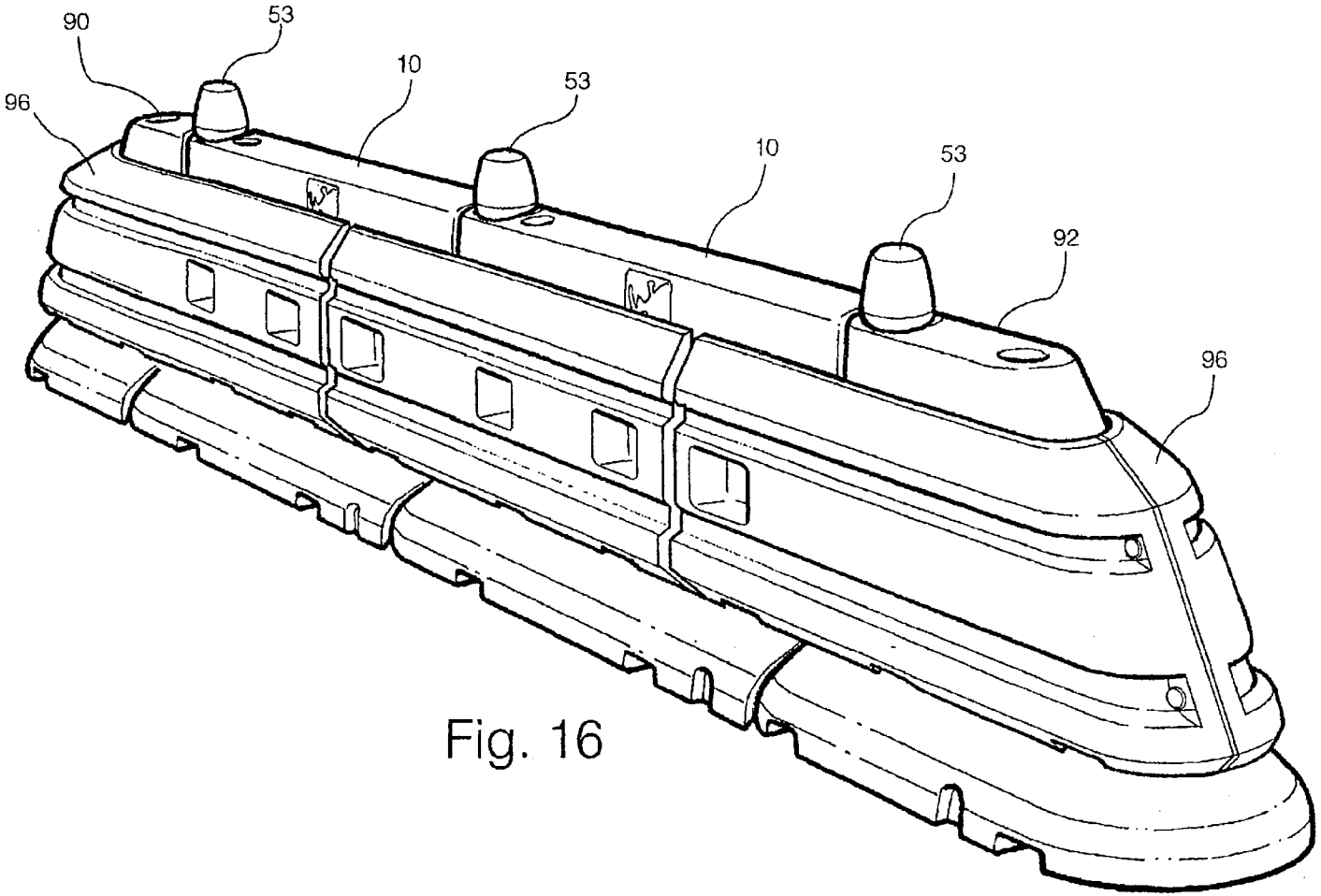
FIG. 16 shows an inflexible barrier assembled from the same components.

As stated above, FIG. 15 shows an assembled barrier constructed as illustrated in FIG. 13. FIG. 16 shows the same components (with the exception of the reinforcing brackets 80 discussed below) assembled into an inflexible barrier. This can be achieved by fixing the reinforcing strips 60 not through the leftmost and rightmost openings 56 of respective barrier sections 10, but through the central opening 56 on one barrier section and the rightmost (or leftmost) opening 56 of the left (or right) adjacent barrier section. Alternatively, additional bosses may be provided on the reinforcing strips 60, allowing them to be fixed through all three openings 56 of one barrier section, or two openings of one barrier section and one opening of the adjacent barrier section. In either case, the reinforcing strips prevent the assembled barrier from flexing because the adjacent barrier sections are no longer free to articulate relative to each other.

FIG. 13 also shows the use of reinforcing brackets 80 that span between two adjacent barrier sections 10 and are retained in place by the bolts (not shown) used to secure the reinforcing strips 60. To this end, each reinforcing bracket 80 includes a pair of apertures 98. The bracket 80 is made from any suitable metal, such as steel, and bent into shape to follow the contours of the barrier section 10. In FIG. 13, each bracket includes a central flat 100 flanked by a pair of inclines 102 and terminates at each end in a marginal flat 104 that is parallel to the central flat and includes a respective aperture 98. A suitably shaped recess 106 is let into each reinforcing strip 60 to accommodate the reinforcing bracket 80. The fixing apertures 98 in the reinforcing brackets 80 may be in the form of horizontal slots to allow the barrier greater flexibility at its points of articulation.

An alternative use of reinforcing brackets 80 that is not illustrated in the drawings would involve placing the brackets 80 outboard of the reinforcing strips 60. This may involve some minor reshaping of the outer surfaces of the reinforcing strips 60. This arrangement possesses the advantage that the reinforcing strips 60 are less likely to be peeled off the barrier sections 10 by the impact of a vehicle at an acute angle to the direction of the barrier. The reinforcing brackets may be shaped to conform with the surface of the in the reinforcing strips, obviating the use of dished, shaped washers. No washers, or flat washers may be used in conjunction with reinforcing brackets so shaped.

A further impact absorbing addition (not shown) could be an inverted U-shaped moulding, filled with cushioning plastics material, foam for example, that is slotted over the tops of the barrier sections. It may be designed to be sacrificial, bursting or tearing on impact for example.

Figure 4:
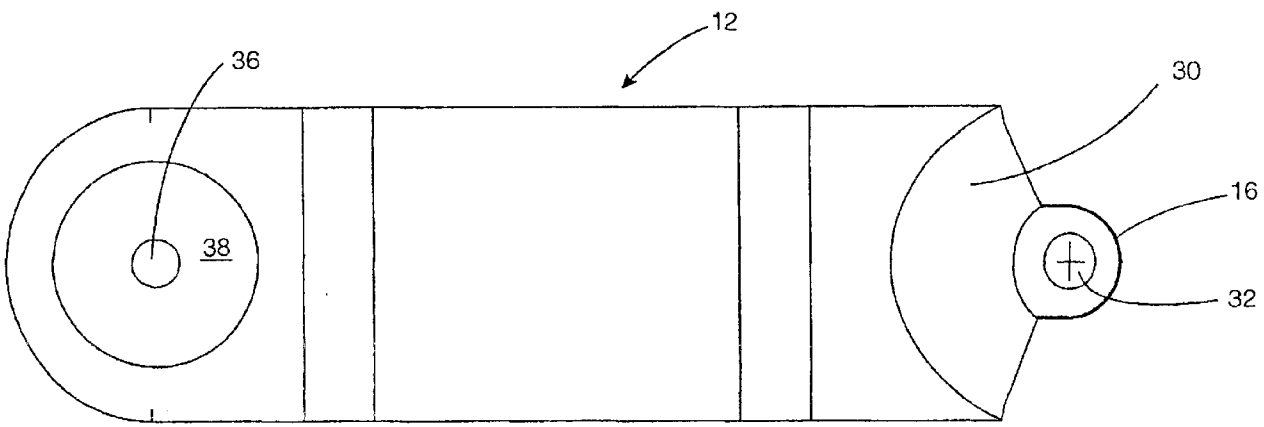
FIG. 4 is an underneath view.
Figure 12:
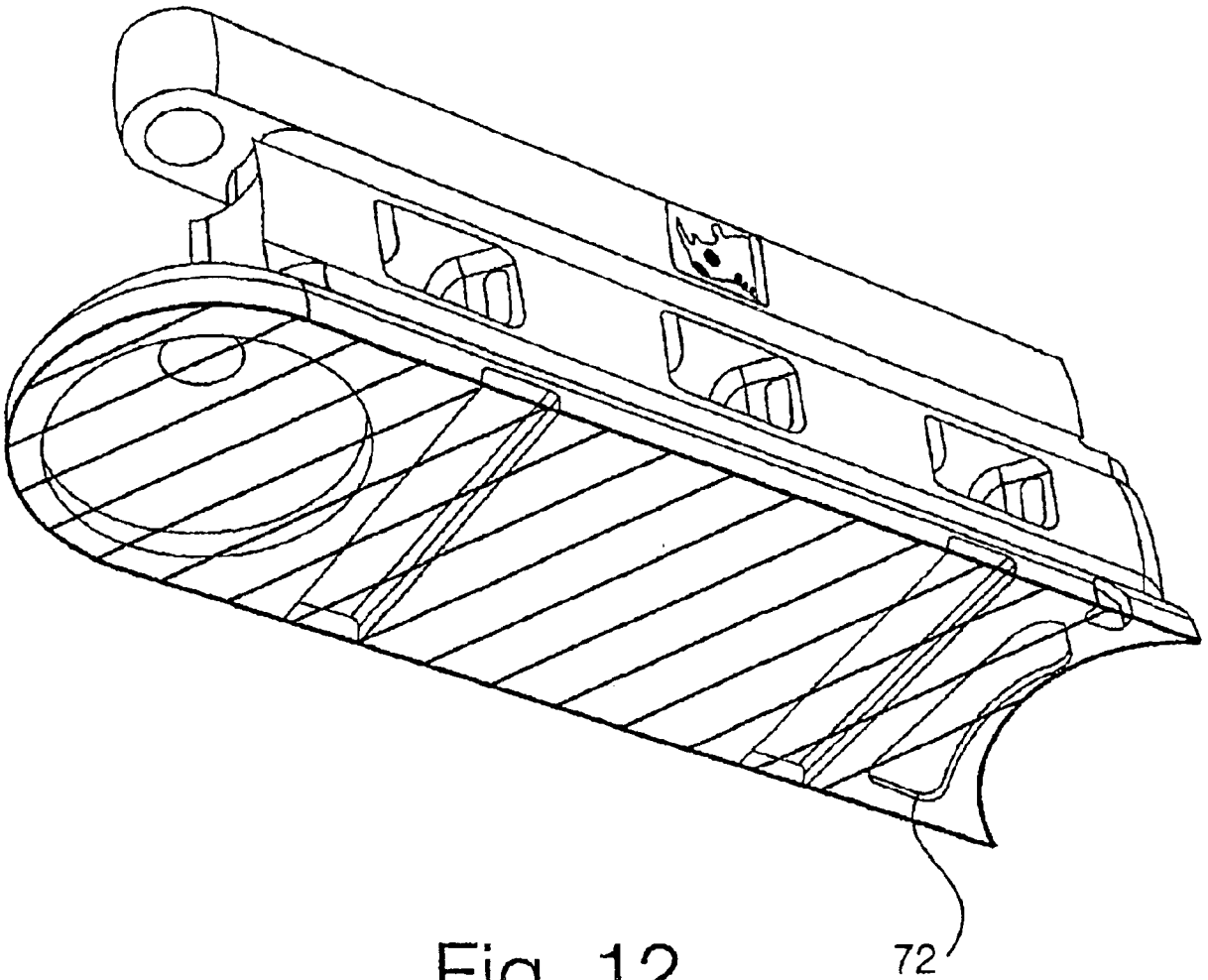
FIG. 12 shows a barrier section with a friction mat.

FIG. 12 shows a barrier section with a friction mat 72. The mat may be fitted into a recess 70 designed for that purpose in the base of the section, as shown in FIG. 4 or may extend across the whole of the base as shown in FIG. 12. Where the recess 70 shown in FIG. 4 is present, and the mat 72 extends across the whole base, it will be thicker in the region of the recess 70, e.g. double thickness, creating an upstand that helps to locate the mat 72 in position. The mat may be high-density rubber or polyurethane foam, preferably with a rough-sawn or other high friction surface.

Figure 6:
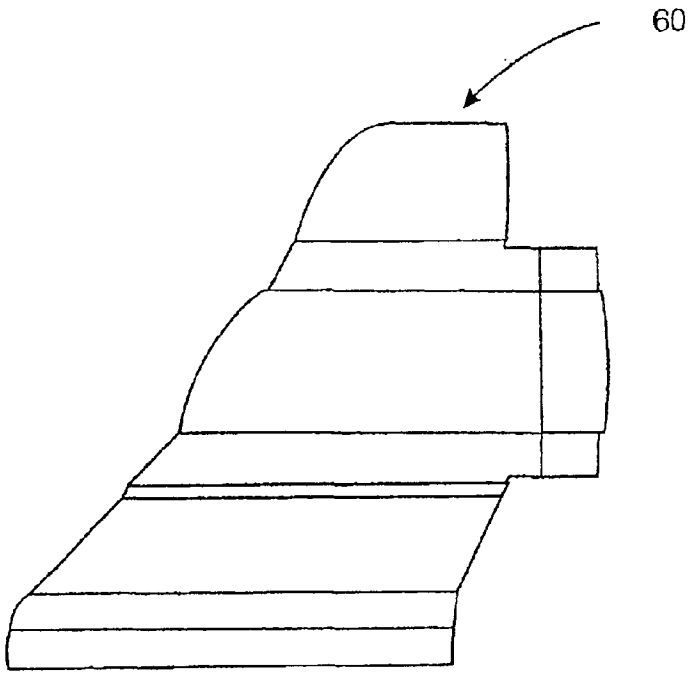
FIG. 6 shows a male end piece.
Figure 5:
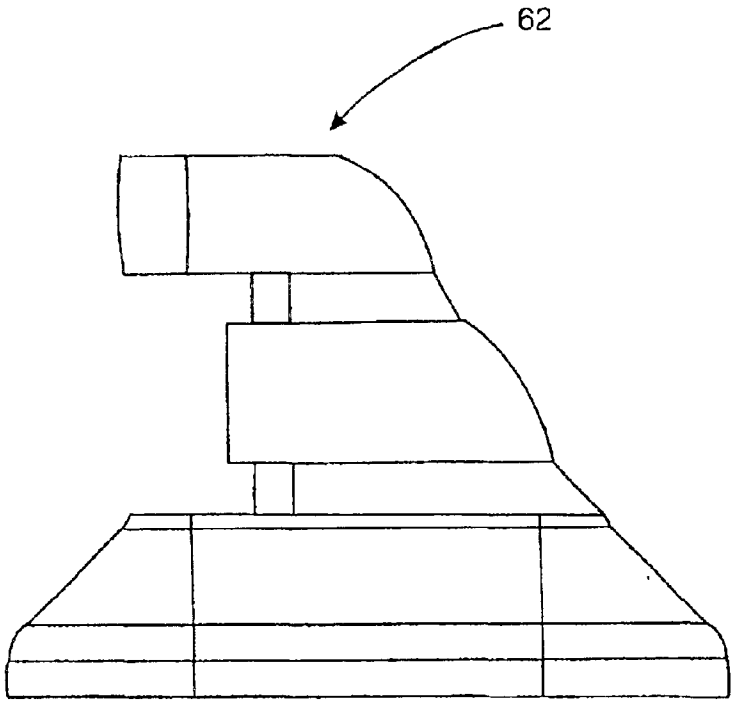
FIG. 5 shows a female end piece.
Figure 10:
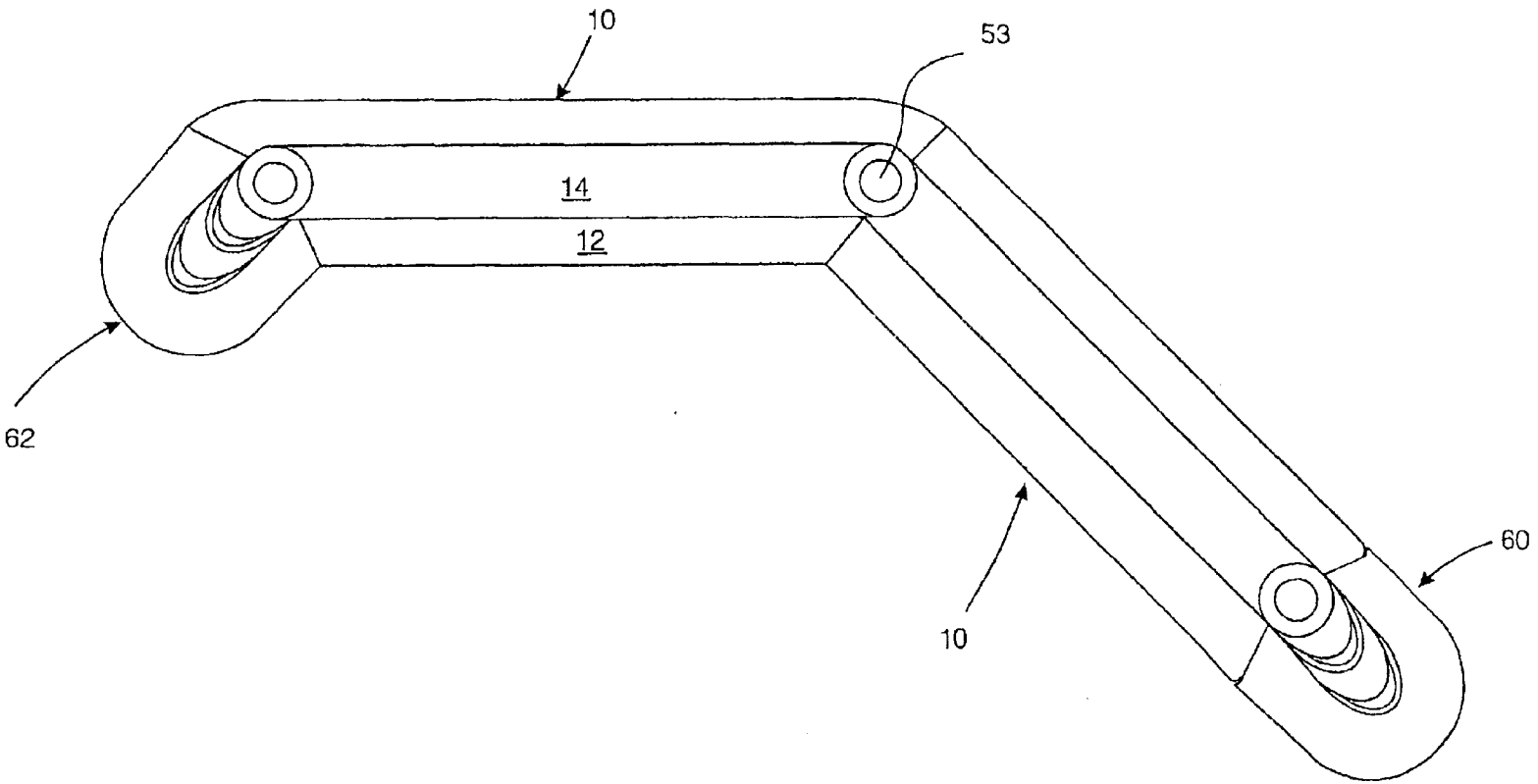
FIGS. 10 and 11 show an assembled crowd control barrier.
Figure 11:
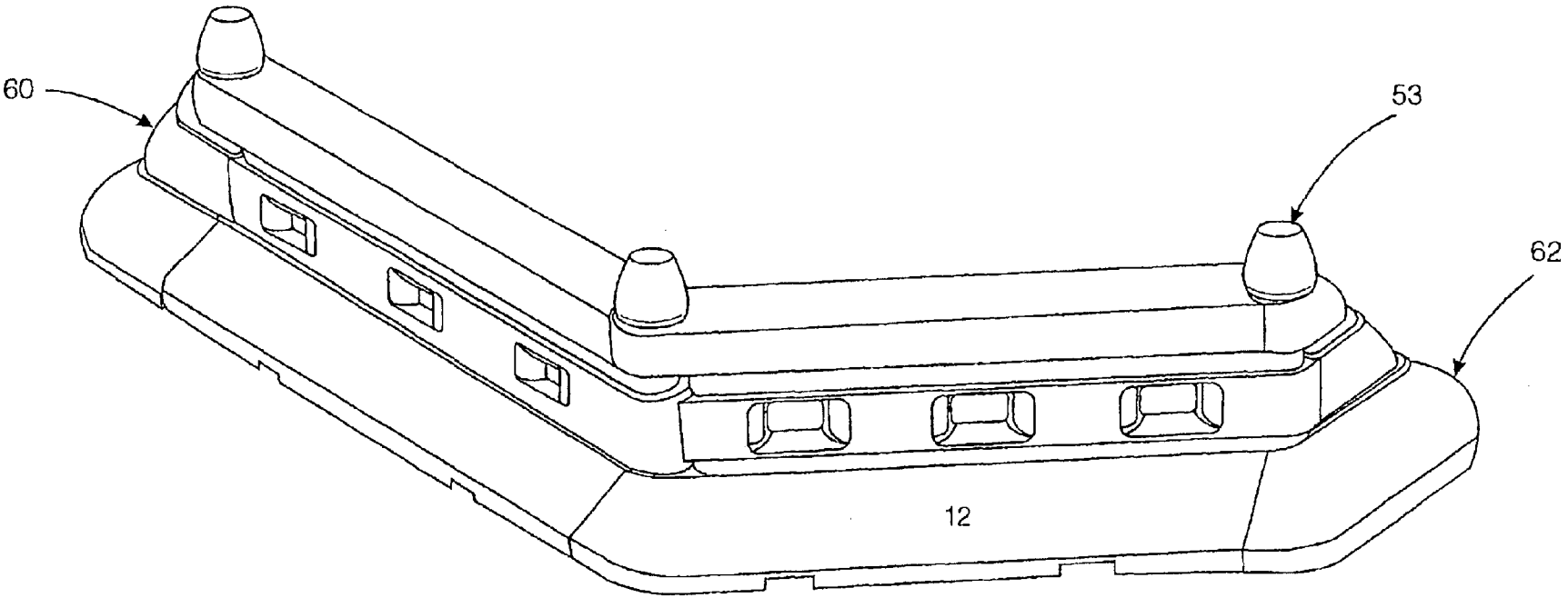

Male and female end pieces 90, 92 are shown in FIGS. 5 and 6. As can be appreciated, these are fixed to the free ends of the terminal barrier sections 10 once the barrier has been erected, to complete the barrier. They are attached to respective barrier sections in exactly the same way as the barrier sections are attached to one another. The fully assembled barrier is shown in FIGS. 10 and 11. A warning light is shown at 53. As FIG. 11 clearly demonstrates, the gaps from which conventional barriers suffer are absent from the present invention, which present an essentially smooth continuous base. This minimises impact damage to driver, vehicle and barrier. In addition, the nose pieces can be positioned at an angle to help guide vehicles into the correct lane, acting somewhat like a funnel. FIG. 13 also shows a terminal reinforcing strip 96 that wraps around the end of an end piece 92.

Whilst the present invention has been described in connection with a unitary barrier section, other arrangements are possible. One example would be a barrier section in which the nose is a separate item, in the form of an enlarged version of the dome-shaped cap described, obviating the separate cap. Both ends of the two barrier sections will then be provided with recesses that accommodate different parts of the nose. If one regards this nose as belonging to one of the barrier sections, and term that its female end, then that barrier section possesses a nose having a surface that is a surface of rotation of the profile of the base portion, as described above.

What is claimed is:

1. A modular crowd and traffic control barrier, comprising:

a plurality, of barrier sections with each barrier section of said plurality of barrier sections comprising a male end and a female end, a base portion and an upright portion having one or more projections at each said male end and said female end of each said barrier section;

a plurality of reinforcing strips;

a plurality of hinge pins;

a tension member for attaching each reinforcing strip of said plurality of reinforcing strips to a respective said barrier section, wherein said tension member passes through aligned apertures in said reinforcing strip and said barrier section;

at least one reinforcing bracket for spanning between two adjacent said barrier sections, said at least one reinforcing bracket having an aperture, wherein said at least one reinforcing bracket is to be retained in place by at least one said tension member of each said barrier section passing through the aperture in said reinforcing bracket, wherein for each said barrier section there is another barrier section of said plurality of barrier sections so that when said female end of a first said barrier section is brought adjacent to said male end of a second said barrier section, said one or more projections of each of said female end and of said male end mate with one another, thereby allowing a hinge pin of said plurality of hinge pins to be passable through said projections for articulating adjacent said barrier sections together; and, wherein said attachment of said plurality of reinforcing strips to said respective said barrier sections continues to permit adjacent said barrier sections to be articulated to one another, while increasing resistance of said modular crowd and traffic control barrier constructed from said plurality of barrier sections to lateral impact forces for traffic control.

2. The modular crowd and traffic control barrier according to claim 1, wherein said upright portion of each said barrier section is comparatively narrow and said base portion is comparatively wide and includes, at said female end of said barrier section, a nose having a surface that is a first surface of rotation and, at said male end, a cavity having a surface that is a second surface of rotation, so that when adjacent said barrier sections are articulated to one another, said cavity accommodates said nose for preventing any gaps from opening up between said base portion of each said barrier section of adjacent said barrier sections as said barrier sections are articulated relative to one another about said hinge pin.

3. The modular crowd and traffic control barrier according to claim 1, wherein there are two reinforcing strips of said plurality of reinforcing strips for each said barrier section with said means for attaching each said reinforcing strip to a respective said barrier section being adapted for attaching one said reinforcing strip to each side of a respective said barrier section.

4. The modular crowd and traffic control barrier according to claim 1, wherein said tension member is a bolt to be tensioned by a cooperating nut.

5. The modular crowd and traffic control barrier according to claim 1, wherein said tension member includes at least one washer for bearing against at least one of said barrier section or said reinforcing strip as said tension member is tensioned.

6. The modular crowd and traffic control barrier according to claim 5, wherein said at least one washer is shaped for matching a shape of a recess surrounding the apertures in said reinforcing strip or said barrier section through which said tension member passes.

7. The modular crowd and traffic control barrier according to claim 1, further comprising additional said tension members.

8. The modular crowd and traffic control barrier according to claim 1, wherein at least one aperture in said reinforcing bracket is a substantially horizontal slot.

9. The modular crowd and traffic control barrier according to claim 1, wherein said reinforcing bracket is located between said reinforcing strips and said barrier sections.

10. The modular crowd and traffic control barrier according to claim 1, wherein said reinforcing bracket is located with said reinforcing strip being between said reinforcing bracket and said barrier section.

11. The modular crowd and traffic control barrier according to claim 1, further comprising an additional reinforcing bracket with said reinforcing bracket and said additional reinforcing bracket spanning between two adjacent said barrier sections with said reinforcing bracket being on a first side of said barrier sections and said additional reinforcing bracket being on a second side of said barrier sections, said first side and said second side being opposite sides of said barrier sections, with said reinforcing bracket and said additional reinforcing bracket being retained in place by at least one said tension member of each said barrier section passing through apertures in said reinforcing bracket and said additional reinforcing bracket.

12. The modular crowd and traffic control barrier according to claim 1, wherein each said barrier section of said plurality of barrier sections is substantially identical.

13. The modular crowd and traffic control barrier according to claim 1, wherein for each said one or more projections on said first said end of said barrier section, a corresponding recess is provided on said second said end.

14. The modular crowd and traffic control barrier according to claim 13, wherein for each said one or more projections a surface that is a surface of rotation is provided with said corresponding recess being correspondingly shaped.

15. The modular crowd and traffic control barrier according to claim 14, wherein for each said one or more projections wherein said surface of rotation of each said one or more projections is part-cylindrical.

16. The modular crowd and traffic control barrier according to claim 2, wherein each of said one or more projections of a said barrier section has a bore and, when said female end of said first said barrier section is brought adjacent to said male end of an adjacent said second said barrier section, so that said nose is accommodated in said cavity, said bore in each of said one or more projections lines up thereby allowing said hinge pin to be passed through said one or more projections for articulating said barrier sections together.

17. The modular crowd and traffic control barrier according to claim 16, wherein said nose further includes a bore for allowing said hinge pin to pass through the bore of said nose.

18. The modular crowd and traffic control barrier according to claim 2, wherein said hinge pin has a male thread for engaging with a female thread in a dome-shaped cap, said nose of said first said barrier section having a domed-shaped recess for accommodating said dome-shaped cap.

19. The modular crowd and traffic control barrier according to claim 1, further comprising tension straps wherein said plurality of barrier sections are held together by said tension straps encircling adjacent said barrier sections, said tension straps crossing from a first side of said modular crowd and traffic control barrier to a second side of said modular crowd and traffic control barrier between said adjacent said barrier sections, said first side being a side opposite said second side of said modular crowd and traffic control barrier.

20. The modular crowd and traffic control barrier according to claim 19, wherein said upright portion of each said barrier section has grooves for accommodating said tension straps.

21. A modular crowd and traffic control barrier, comprising:

a plurality of barrier sections with each barrier section of said plurality of barrier sections comprising a base portion and an upright portion having one or more projections at each end of each said barrier section with a first said end being a female end of said barrier section and a second said end being a male end of said barrier section;

a plurality of reinforcing strips;

a plurality of hinge pins, said upright portion of each said barrier section is comparatively narrow and said base portion is comparatively wide and includes, at said female end of said barrier section, a nose having a surface that is a first surface of rotation and, at said male end, a cavity having a surface that is a second surface of rotation, so that when adjacent said barrier sections are articulated to one another, said cavity accommodates said nose for preventing any gaps from opening up between said base portion of each said barrier section of adjacent said barrier sections as said barrier sections are articulated relative to one another about a hinge pin of said plurality of hinge pins, said hinge pin having a male thread for engaging with a female thread in a dome-shaped cap, said nose of a first said barrier section having a domed-shaped recess for accommodating said dome-shaped cap; and, means for attaching each reinforcing, strip of said plurality of reinforcing strips to a respective said barrier section, wherein for each said barrier section there is another barrier section of said plurality of barrier sections so that when said female end of a first said barrier section is brought adjacent to said male end of a second said barrier section, said one or more projections of each of said female end and of said male end mate with one another, thereby allowing a hinge pin of said plurality of hinge pins to be passable through said projections for articulating adjacent said barrier sections together, and wherein said attachment of said plurality of reinforcing strips to said respective said barrier sections continues to permit adjacent said barrier sections to be articulated to one another, while increasing resistance of said modular crowd and traffic control barrier constructed from said plurality of barrier sections to lateral impact forces for traffic control.

* * * * *